United States Patent [19]

Milianowicz et al.

[11] Patent Number: 4,491,704

[45] Date of Patent: Jan. 1, 1985

[54] VACUUM CIRCUIT INTERRUPTER HAVING VACUUM MONITORING APPARATUS

[75] Inventors: Stanislaw A. Milianowicz, Monroeville; Norman Davies, Penn Township, Westmoreland County; Charles K. Wallace, Penn Hills Township, Allegheny County, all of Pa.

[73] Assignee: Westinghouse Electric Corp., Pittsburgh, Pa.

[21] Appl. No.: 488,235

[22] Filed: Apr. 25, 1983

[51] Int. Cl.[3] ..... H01H 33/66

[52] U.S. Cl. ..... 200/144 B

[58] Field of Search ..... 200/144 B

[56] References Cited

U.S. PATENT DOCUMENTS 3,263,162 7/1966 Lucek et al. ..... 200/144 B 4,103,291 7/1978 Howe et al. ..... 200/144 B

*Primary Examiner*—Robert S. Macon

*Attorney, Agent, or Firm*—Benjamin Hudson, Jr.

[57] ABSTRACT

There is provided by this invention a vacuum monitoring device for use in vacuum circuit interrupters comprising a stacked resistor assembly as a voltage divider coupled to an internal shield of the vacuum bottle and a low voltage detection circuit for monitoring leakage currents under abnormal pressure conditions.

3 Claims, 5 Drawing Figures

VACUUM CIRCUIT INTERRUPTER HAVING VACUUM MONITORING APPARATUS

CROSS-REFERENCE TO RELATED APPLICATION

This application is related to a copending patent application Ser. No. 226,232 filed Jan. 19, 1981, entitled "Vacuum Circuit Interrupter With Insulated Vacuum Monitor Resistor."

BACKGROUND OF THE INVENTION

1. Field of the Invention:

This invention relates generally to vacuum circuit interrupters and more particular to vacuum circuit interrupters having high voltage vacuum monitoring devices which utilize leakage currents between metallic parts to indicate abnormal pressure conditions within the vacuum circuit interrupter.

2. Description of the Prior Art:

Vacuum circuit interrupters are generally comprised of a pair of separable contacts operated within an evacuated enclosure. Typically, the internal portion of the enclosure is evacuated to a pressure of $10^{-4}$ torr or less. The vacuum has a high dielectric strength per unit distance of separation between the separable contacts to efficiently extinguish arcs generated upon opening the contacts. The high dielectric strength maintained by the vacuum sufficiently prevents restriking of the arc once separation has been made. To ensure sufficient and safe operation of vacuum circuit interrupters, it is required that the pressure within the enclosure be kept below a predetermined value to maintain the dielectric strength required.

It is known in the prior art to use vapor deposition shields within the evacuated enclosure as a means of detecting leakage currents within the circuit interrupter under abnormal pressure conditions. For example, U.S. Pat. No. 3,263,162 entitled "Apparatus and Method for Measuring the Pressure Inside a Vaccum Interrupter" by J. R. Lucek et al. and U.S. Pat. No. 3,403,297 entitled "Vaccum-Type Circuit Interrupters with Pressure Monitoring Means" by D.W. Crouch teach such methods. Additionally, U.S. Pat. No. 4,351,992 entitled "High Potential Testing of Vacuum-type Circuit Interrupters" issured to D. W. Crouch teaches monitoring means for vacuum circuit interrupters having a metallic housing. However, power engineers continue to seek more effective and efficient ways to monitor the vacuum in vacuum circuit interrupters.

SUMMARY OF THE INVENTION

There is provided by this invention a unique vacuum circuit interrupter having a stacked resistor assembly electrically connected to a internal vapor deposition shield which monitors the vacuum as a function of leakage current developed between two metal vapor deposition shields for example, within the circuit interrupter under abnormal pressure conditions. To interface the high voltage metal vapor deposition shield with a low voltage control circuit for monitoring the pressure within the circuit interrupter, the high impedance stacked resistor assembly is comprised generally of a number of resistor segments made in doughnut-type shapes threaded over an insulating rod which serves as a means to provide location of the resistor segments and also axial retention of the segments.

BRIEF DESCRIPTION OF THE PREFERRED EMBODIMENT

Figure 1:
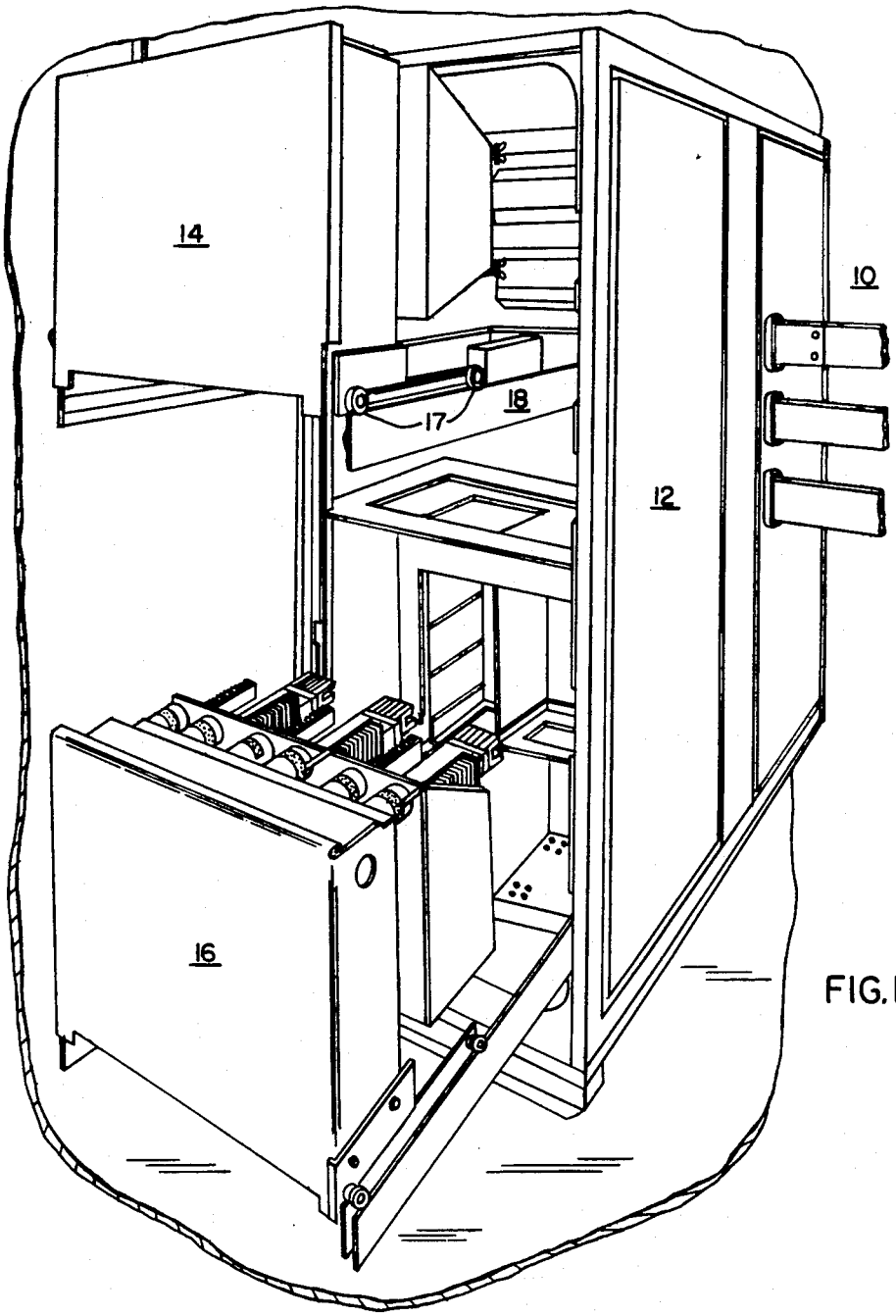
FIG. 1 shows an orthogonal view of a metal-enclosed switchgear vacuum circuit interrupters employing the principles of this invention.
Figure 2:
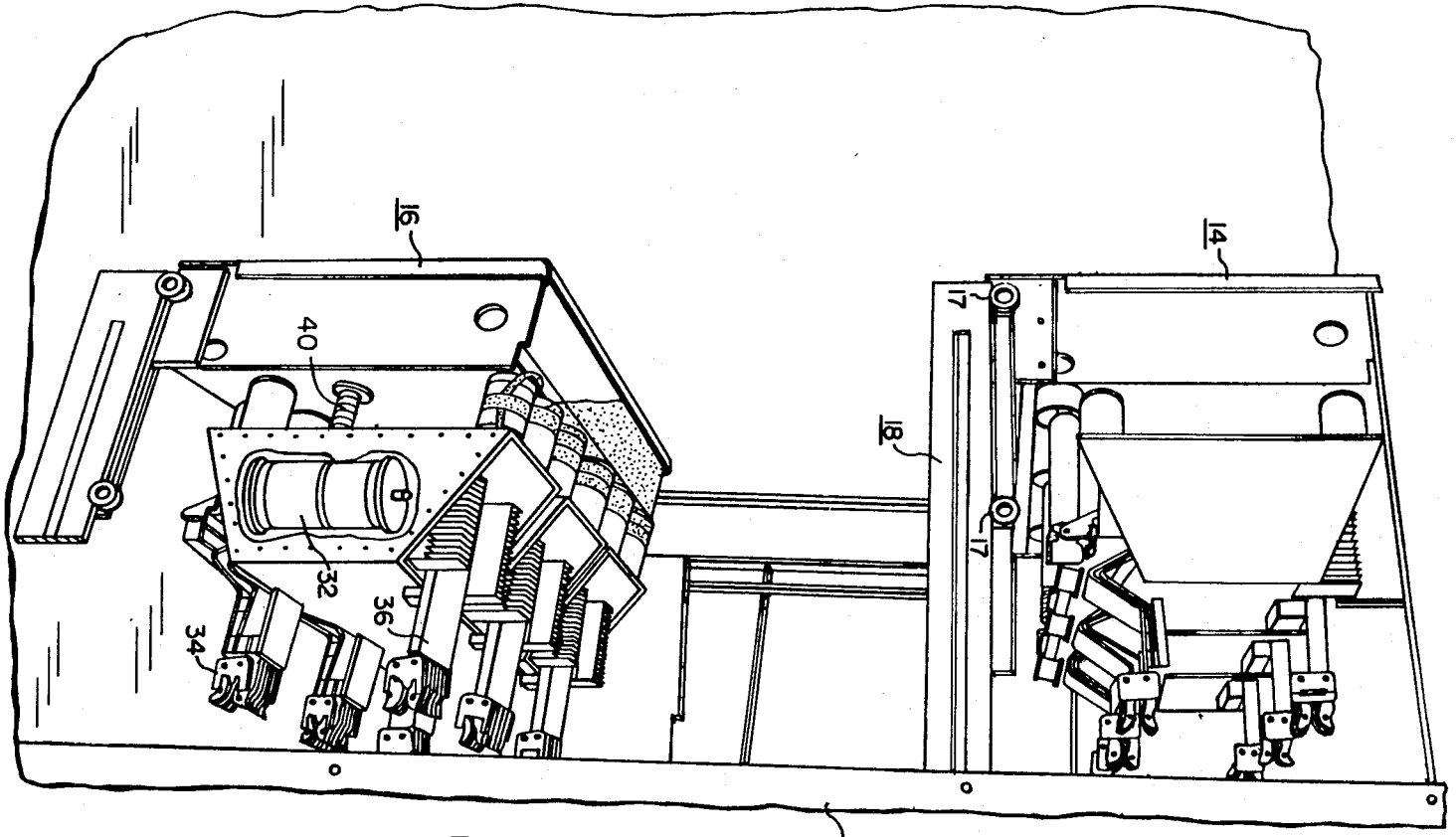
FIG. 2 shows another orthogonal view of the apparatus of FIG. 1.

Referring to FIGS. 1 and 2 of the drawings, there is shown metal-enclosed switchgear 10 which includes a metal cabinet or enclosure 12 having tandem vertically disposed, draw out type, three-phase circuit interrupter apparatuses 14 and 16. The circuit interrupter apparatus 14 and 16 are mounted on wheels 17 and rails 18 for moving the circuit breaker apparatus into and out of the metal enclosure 12. The circuit interrupter apparatus 14 and 16 generally comprise vacuum circuit interrupter bottles 32 which are electrically connected to three-phase terminals 34 and 36 disposed to make electrical contact with primary terminals (not shown) in the rear of the cabinet when the circuit interrupter apparatuses are moved into the metal enclosure 12 in their normal operating position in a manner well known in the art.

Figure 3:
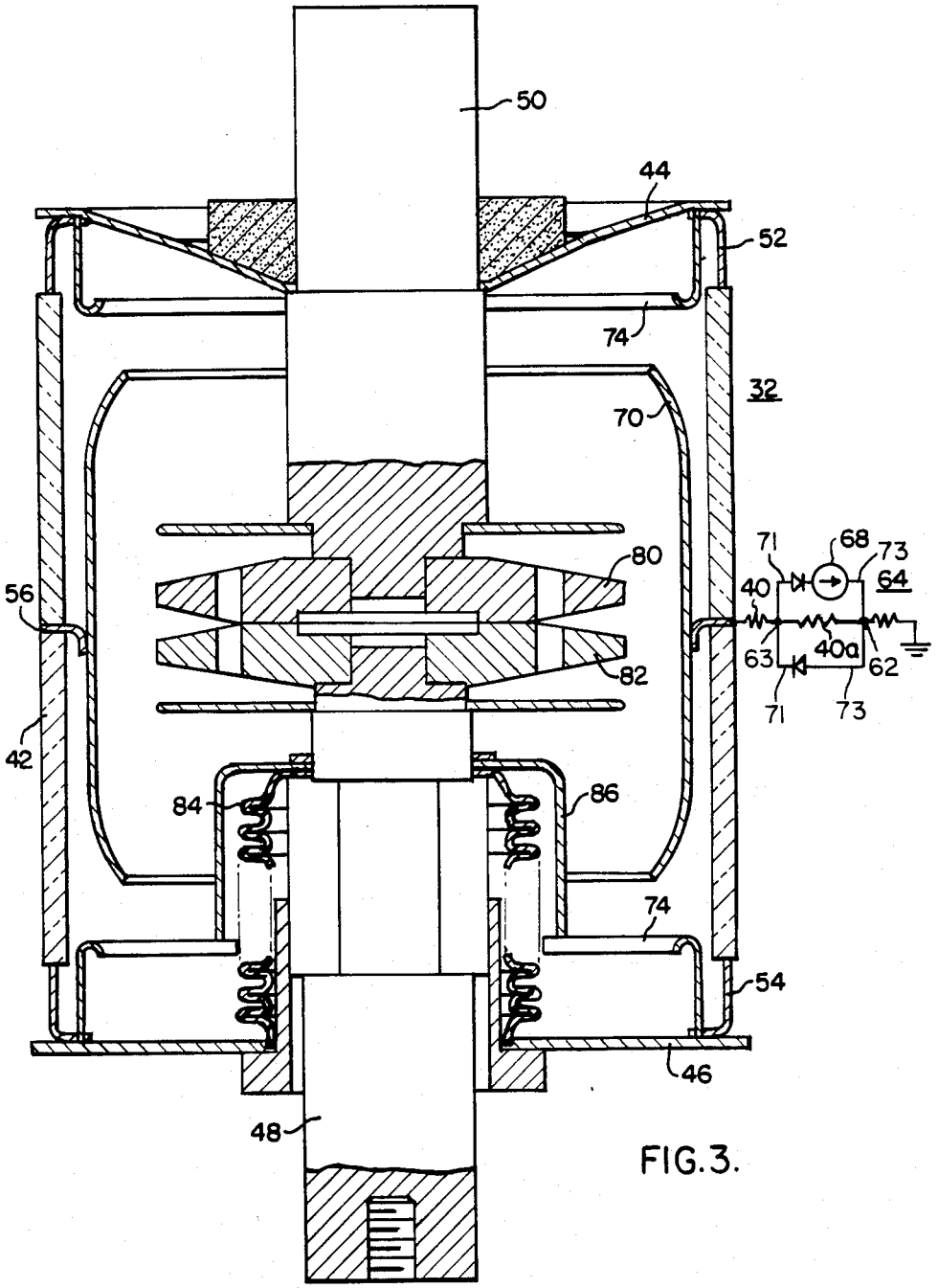
FIG. 3 is a sectional view of the vacuum circuit interrupter and a schematical representation of the vacuum monitoring circuit incorporating the principles of this invention.

Referring now to FIG. 3, a sectional view of the circuit interrupter bottle 32 shown. The circuit interrupter bottle 32 generally comprises electrically conducting end plates 44 and 46 interconnected with an insulating cylinder 42 at regions 52 and 54, respectively. Enclosed within the insulating cylinder 42 are separable electrical contacts 80 and 82. The contacts 80, 82 are supported by means of contact stems 50 and 48, respectively, which extend through the end plates 44, 46 respectively. The contact stems 48, 50 are connected to the three-phase terminals 34, 36 previously shown in FIG. 2. The volume defined by the circuit interrupter bottle 32 is substantially evacuated by appropriate cementing or sealing processes utilized to make the sealed vacuum reliable. Operating mechanisms not shown but well known in the art are disposed to operate the contacts 80, 82 between open and closed positions within the substantially evacuated circuit interrupter bottle 32 which provide the circuit-interrupting capability. Metal vapor deposition shields 70, 74, 76 are provided to prevent arc vapor products and heat generated upon opening of the contacts 80, 82 from being deposited against the inside walls of the insulating cylinder 42 to prevent degradation of the housing. The shield 74 is suspended within the vacuum interrupter 32 from the end plate 44 while a similar shield 74 is suspended or supported by the end plate 46. Typically, the centrally located shield 70 is brazed or otherwise interconnected with an annular ring 56 which is sandwiched in between two portions of the insulator 42 for support thereby. There may also be provided an internal shield 86 for a bellows 84. The bellows 84 is expandable with and contractible with the moveent of the stem 48 to maintain vacuum integrity. Consequently, the internal portion of the circuit interrupter bottle 32 is normally vacuum-tight. The vacuum represents a desirable region in which to interrupt current flowing between contacts 80, 82 as stem 48 moves downwardly to cause a separation or gap to exist between the contacts 80, 82. The opening of the contacts 80, 82 creates an arc which extinguishes on the next current zero due to the insulative dielectric properties of the vacuum.

According to the principles of this invention, the annular ring 56 that supports the centrally disposed vapor shield 70 is used to monitor the state of the vacuum when the vacuum bottle is connected between the high voltage terminals 34, 36. High impedance resistors **40, 40*a* are connected to the annular ring 56 and functions as a voltage divider to couple a low voltage current detection circuit 64 at the low voltage resistor segment 40*a* to the vacuum interrupter. The circuit 64 may comprise rectifiers and a microammeter 68 disposed to measure the leakage current flowing through the resistors 40, 40*a* to ground. This circuit is designed to detect any leakage current that may result from gas ionization within the vacuum bottle 32** in the event that the insulating dielectric strength within the bottle is reduced due to loss of the vacuum.

Figure 4:
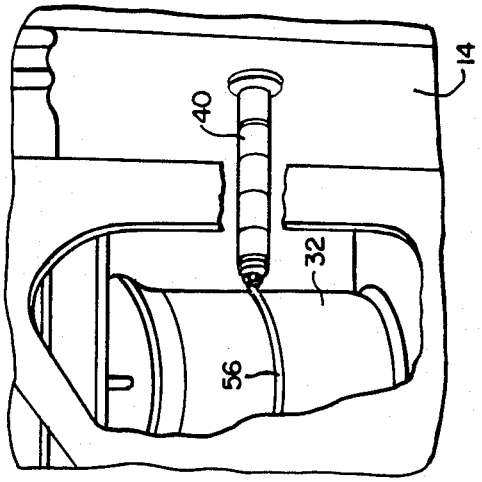
FIG. 4 shows view of the vacuum circuit breaker and resistor assembly partially broken away which incorporates the principles of this invention.
Figure 5:
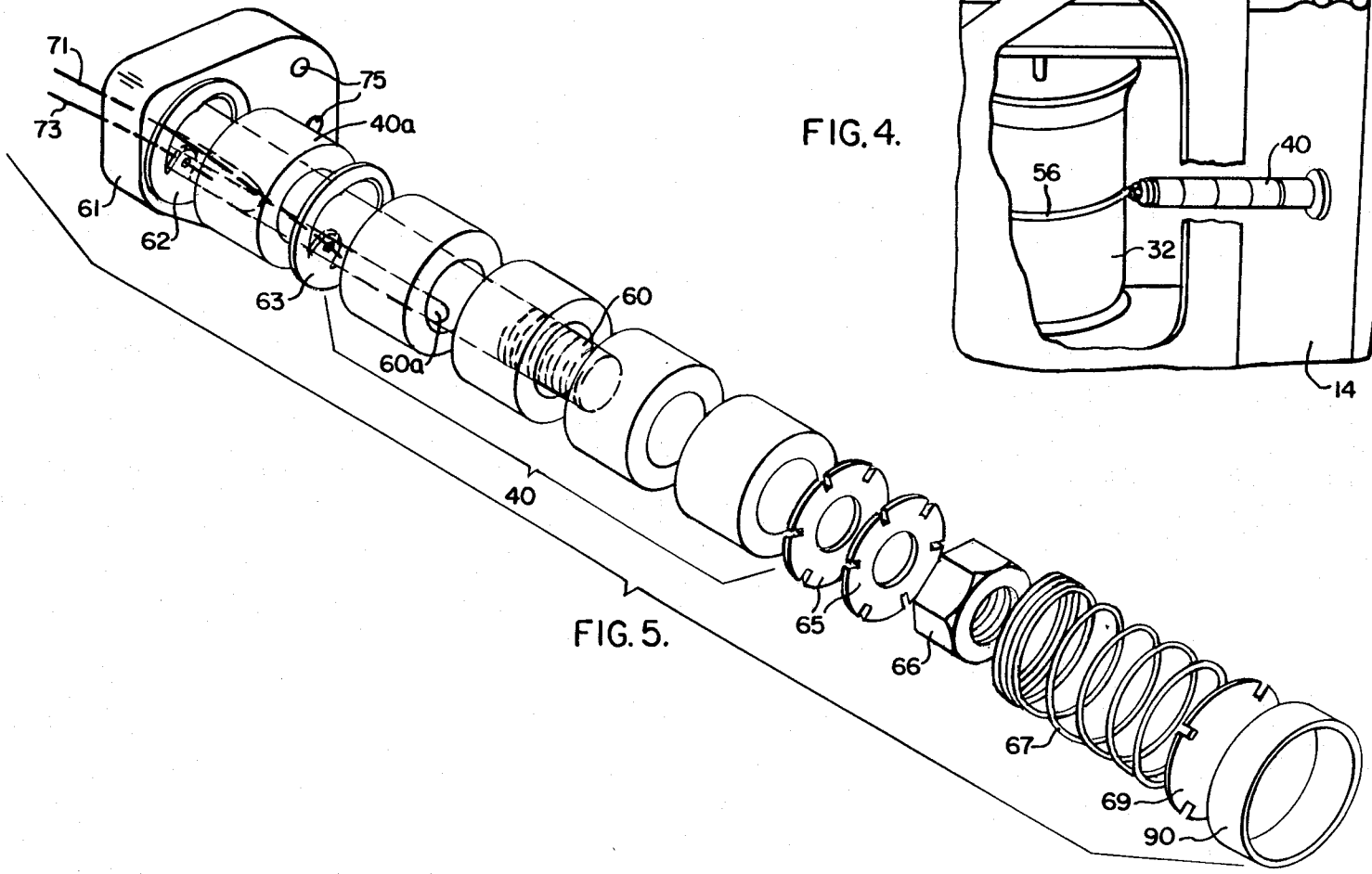
FIG. 5 shows a perspective view of the resistor-stack assembly incorporating the principles of this invention.

As can be seen in FIGS. 2, 4, and 5, a unique method is employed to attach the resistive elements **40, 40*a* to the annular ring 56 in the vacuum bottle for current-detection purposes. The resistor assembly is comprised generally of an insulating rod 60 having a base 61 for being mounted to the circuit interrupter apparatus 14, 16. Over the insulating rod are placed terminal rings 62, 63, resistive elements 40, 40*a*, disc springs 65, a nut 66 which screws on to a threaded portion of the insulating rod for supporting the resistive elements thereto, an electrical connecting spring 67 and a connector 69 for maintaining the resistive elements in a continuous contact with the annular ring 56 of the insulating bottle 32 as shown in FIGS. 2 and 4. The base 61 is hollow and the insulating rod 60 has a groove 60*a* therein for conductors 71, 73 which connect in to the connector rings 62, 63, respectively, as shown. Mounting holes 75 may be provided in the base 61 for connecting the insulating rod assembly 60** to the circuit interrupter apparatus.

Additionally there can be provided a protective insulating coating, not shown, such as epoxy paint, applied over the resistive elements **40, 40*a*, disc springs 65, and terminal rings 62, 63. Such protective cooling can also take the form of an insulating sleeve 90** which can slide over the aforementioned parts or be heat shrunk over them.

Although there has been illustrated and described a specific structure, it is to be clearly understood that the same were merely for purposes of illustration and that changes and modifications may be readily made therein by those skilled in the art without departing from the spirit and scope of this invention.

What we claim is:

1. A vacuum circuit interrupter, comprising:

a. a support frame;

b. a substantially evacuated insulated housing disposed upon said support frame;

c. an electrical conductor means, a portion of which is disposed within said housing and a portion of which is external of said housing;

d. arc shielding means spaced from said electrical conductor means and disposed within said housing to shield the internal portion of said housing from arcing products during a circuit interruption, said arc shield means being electrically conductive and having an external portion which extends through said housing so as to provide electrical continuity to a region outside of said housing;

e. electrically insulating rod means disposed on said support frame;

f. first resistance means having an annular opening therein for disposal upon said rod means;

g. second resistance means having an annular opening therein for disposal on said rod means;

h. electrically conductive ring means having an annular opening therein for being disposed on said rod means between one portion of said first resistance means and one portion of said second resistance means, another portion of said first resistance means disposed in electrical contact with said external portion of said arc shield means, and another portion of said second resistance means being disposed to complete an electrical circuit with said electrical conductor means; and i. current detection means interconnected between said electrically conductive ring means and said another portion of said second resistance means for determining leakage electrical current in said housing between said electrical conductor means and said arc shield means as a function of the voltage drop across said second resistance means through which said leakage current flows.

2. A vacuum circuit interrupter as recited in claim 1 wherein said combination of said first resistance means, said second resistance means and said intermediate electrically conductive ring have an insulating protective cover.

3. The combination as claimed in claim 1 including a second electrically conductive ring means disposed on said rod means in electrical contact with said another portion of said second resistance means for electrical interconnector with said current detection means for completing said electrical circuit therebetween.

* * * * *